US010321745B2

(12) United States Patent
Chen et al.

(10) Patent No.: US 10,321,745 B2
(45) Date of Patent: Jun. 18, 2019

(54) INNOVATIVE PACKAGING FOR FLUID PRODUCT

(71) Applicants: Wensheng Chen, Jiangsu Province (CN); Andrea Perego, Castello di Brianza (IT)

(72) Inventors: Wensheng Chen, Jiangsu Province (CN); Andrea Perego, Castello di Brianza (IT)

( * ) Notice: Subject to any disclaimer, the term of this patent is extended or adjusted under 35 U.S.C. 154(b) by 140 days.

(21) Appl. No.: 15/430,866

(22) Filed: Feb. 13, 2017

(65) Prior Publication Data

US 2017/0245618 A1 Aug. 31, 2017

(30) Foreign Application Priority Data

Feb. 18, 2016 (IT) ..... 102016000016859

(51) Int. Cl.
*A45D 34/04* (2006.01)

(52) U.S. Cl.
CPC ..... *A45D 34/045* (2013.01); *A45D 34/043* (2013.01); *A45D 2200/1036* (2013.01)

(58) Field of Classification Search
CPC ..... A45D 34/00; A45D 34/04; A45D 34/045
USPC ..... 401/118–130
See application file for complete search history.

(56) References Cited

FOREIGN PATENT DOCUMENTS

| | | |
|---|---|---|
| EP | 0 384 026 A2 | 8/1990 |
| EP | 0 836 862 A1 | 4/1998 |

*Primary Examiner* — David J Walczak
*Assistant Examiner* — Joshua R Wiljanen
(74) *Attorney, Agent, or Firm* — Vorys, Sater, Seymour and Pease LLP

(57) ABSTRACT

Provided is a packaging for a fluid product, in particular a cosmetic or a skin care product. The packaging may include a receptacle defining a containment volume of the cosmetic product and an opening into the containment volume. The packaging may further include a lid configured to engage with the receptacle and close the opening. Further, the packaging may also include an applicator configured to withdraw the cosmetic product from the containment volume. The packaging may additionally include a containment and release body arranged in the containment volume and saturated with the cosmetic product so that, when deformed by the applicator, it releases the cosmetic product on the applicator.

10 Claims, 3 Drawing Sheets

3a
3
3b
4
5
2b
2a
6
2

71
72
8
1
7
3
6
2

71
2b
2a
6
72
4

1a
1
7
3
2

INNOVATIVE PACKAGING FOR FLUID PRODUCT

FIELD OF THE INVENTION

The object of the present invention is a packaging for a fluid product of the type comprising: a receptacle defining a containment volume of the cosmetic product and an opening into the containment volume; a lid suitable to engage with the receptacle to close the opening; an applicator suitable to withdraw and to dose at least part of the cosmetic product from the containment volume; a containment and release body arranged in the containment volume and impregnated with the cosmetic product and suitable to be deformed by the applicator so as to release the cosmetic product on the applicator.

DESCRIPTION OF THE PRIOR ART

In particular, the object of the present invention is a device used to contain and, preferably, apply a cosmetic product and, preferably, a liquid cosmetic product, that is to say a cosmetic product in liquid or cream form. The cosmetic product may thus be a mascara, a lip gloss, a lipstick, an eye liner, a kajal, a foundation, a concealer, a skin care product or other product.

A similar device is described in patent application EP-A-0836862.

As is known, the packaging used for liquid cosmetic products consists of a receptacle for the liquid cosmetic product and a lid for closing the base by means of a threaded coupling.

Integral with the lid, the packagings known in the prior art comprise an applicator consisting of a cylindrical stem integral with the lid at one end and with an applicator for the liquid cosmetic product at the opposite end. Said applicator may be a brush, a spatula, a sponge or the like.

The prior art described above has several significant drawbacks.

A first important drawback is that as the liquid cosmetic product is used up, it becomes more difficult to spread evenly on the applicator. This drawback makes it hard to apply the makeup properly. As the cosmetic product is used up, and there is less left in the receptacle, the user cannot immerse the entire applicator in the liquid cosmetic product. As a result, part of the applicator does not get covered in the liquid cosmetic product, which cannot therefore be applied to the skin.

The user must perform complicated operations to overcome this problem.

For example, with each application the user must screw the lid on to the receptacle so that the applicator reaches as far down inside the receptacle as possible and, thus, increases the portion that comes into contact with the liquid cosmetic product.

Another possible operation for withdrawing the liquid cosmetic product when there is very little left consists of tilting the packaging so that the product runs out, with the risk of it soiling clothing, furniture or other objects.

Such operations do not represent an ideal solution in that they do not allow all of the liquid to be used since, when it is almost finished, it cannot be reached by the applicator.

Furthermore, owing to the need to impregnate the applicator with the liquid cosmetic product several times while applying the makeup, the operations described above have to be performed many times, so that the whole process takes longer.

A further drawback is the waste that is generated owing to the fact that it is impossible to use all of the liquid cosmetic product.

Another no less important drawback lies in the fact that since the liquid comes into contact with the air and has a high volatile substance content (i.e.: a solvent such as Isododecane), it tends to dry up and so can no longer be used.

Yet another drawback is that when the applicator is immersed in the liquid, too much liquid may be deposited on the applicator, making it extremely difficult to apply.

This drawback is only partially solved by a cleaning of the applicator on the edge of the container, usually made by the user for example with mascara. The said cleaning follows, in fact, an accumulation of product on the same edge of the container. This accumulation can be uncomfortable and dirtying the user's hands or other.

Another, no less important drawback lies in the fact that the liquid content may leak out of the container if the lid is not tightly closed.

Finally, although it is usually present a scraper to clean the applicator and the rod that connects it to the lid, a portion of the product can always remain in the same portion of the rod closest to the scraper itself.

SUMMARY OF THE INVENTION

In this situation the technical purpose of the present invention is to devise a packaging for a fluid product that substantially overcomes the drawbacks mentioned above.

Within the scope of said technical purpose an important aim of the invention is to provide a packaging which allows all of the cosmetic product, and preferably, the liquid cosmetic product, to be used quickly and in a practical manner.

A further aim of the invention is thus to provide a packaging which allows the cosmetic product to be used regardless of how much of the product remains in said packaging.

Yet another important aim of the invention is to provide a packaging for a cosmetic product that allows the ideal amount of the latter to be dispensed.

A further important aim of the invention is to provide a packaging for a cosmetic product in which the risk of the liquid product leaking is reduced to a minimum.

The technical purpose and specified aims are achieved with a packaging for a fluid product comprising: a receptacle defining a containment volume of the cosmetic product and an opening into the containment volume; a lid suitable to engage with the receptacle to close the opening; an applicator suitable to withdraw and to dose at least part of the cosmetic product from the containment volume; a containment and release body arranged in the containment volume and impregnated with the cosmetic product and suitable to be deformed by the applicator so as to release the cosmetic product on the applicator, a mover, to move the applicator with respect to the containment and release body, defining, while the lid is engaged with the receptacle closing the opening, a raised position in which the applicator is at the maximum distance from the bottom of the receptacle; and at least a lowered position in which the distance of sad applicator from the bottom of the receptacle is less than the maximum distance so that the applicator deforms the containment and release body and withdraws at least part of the cosmetic product.

BRIEF DESCRIPTION OF THE DRAWINGS

The features and advantages of the invention are clearly evident from the following detailed description of preferred embodiments thereof, with reference to the accompanying drawings, in which.

Figure 2B:
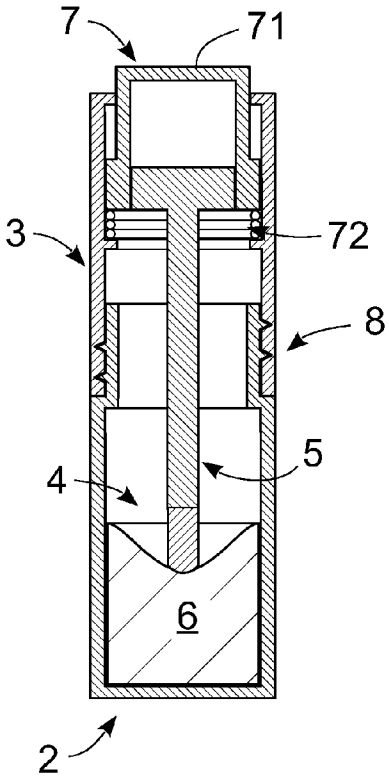
FIG. 2*b* shows the cross-section of FIG. 2*a* in a different configuration.

In this document, measurements, values, forms and geometric data (such as perpendicularity and parallelism), when used with terms such as "about" or other similar terms such as "practically" or "substantially", are to be considered without any measurement errors or inaccuracies due to production and/or manufacturing errors and, above all, without any slight divergence from the value, measurement, form or geometric data with which they are associated. For example, such terms, when associated with a value, preferably indicate a difference of not more than 10% of said value.

With reference to said Figures, reference numeral 1 globally denotes the packaging for a fluid product according to the invention.

It is suitable for containing a cosmetic product and for permitting the application thereof. In particular, the packaging 1 is suitable for containing and thus, for permitting the application of a liquid cosmetic product, that is to say a cosmetic product in the form of a liquid or cream. The packaging 1 is thus for a mascara, a lip gloss, a lipstick, an eye liner, a kajal, a concealer, a skin care product or other products.

It is preferably a box-shaped body defining a longitudinal axis 1*a* and comprising, in brief, a receptacle 2, a lid 3 and an applicator 4.

The receptacle 2 defines a containment volume 2*a* of the cosmetic product and an opening 2*b* into the containment volume 2*a* and, thus, to the cosmetic product.

The lid 3 is suitable to engage with the receptacle 2 so as to close the opening 2*b* and prevent access to said product.

The lid 3 and the receptacle 2 and, thus, the volume 2*a* mainly extend along the longitudinal axis 1*a*. Therefore, the packaging 1 may be of a prismatic or cylindrical shape.

Conveniently, the cross-section of the opening 2*b* may be smaller than the cross-section of the containment volume 2*a*.

The applicator 4 may be chosen from between: a brush for example in the case of packaging 1 for a mascara, an eye liner, a foundation, or a kajal; a sponge or a flocked applicator in the case of packaging 1 for a lip gloss, concealer or lipstick; or another similar element suitable to permit the withdrawal, the dosing and the application of the product and, in particular, of the liquid cosmetic product. It may be in different materials, such as polymeric material or also in ceramic or metal.

The applicator 4 may be joined, conveniently integrally, to the lid 3 and the packaging 1 may thus comprise a stem 5 suitable to join the applicator 4 to the lid 3.

In particular, the stem 5 is joined to the applicator 4 on an internal face (i.e. facing towards the volume 2*a*) of the lid 3 so that, when the lid 3 engages with the receptacle 2, the applicator 4 faces and is at least partially inserted in the containment volume 2*a*.

Innovatively, the packaging 1 may comprise a containment and release body 6 arranged, preferably entirely, inside the containment volume 2*a*.

Such containment and release body 6 is adapted to absorb liquid and to release the product under pressure. The liquid product is then preferably substantially immediately visible in the liquid phase.

The containment and release body 6 may be a porous body, such as a spongy body, a mesh or more.

Said containment and release body 6 is impregnated and, preferably, saturated with the cosmetic product and, in detail, with the liquid cosmetic product. Thus, when the containment and release body 6 is elastically deformed by the applicator 4, it releases the cosmetic product on the applicator 4 so that it can be withdrawn and subsequently applied.

The containment and release body 6 is thus soaked in the cosmetic product and, in particular, the liquid cosmetic product so as not to release said cosmetic product and, in particular, the liquid cosmetic product, unless it is deformed, that is to say, unless it is made to contract, preferably by the applicator 4.

The containment and release body 6 is made of reticulated polymer, in particular reticulated polyester urethane foam.

Furthermore, in a variant not illustrated in the figures, the containment and release body 6 comprises a cavity counter-shaped to the applicator 4, with partial interference. This feature allows to better dosing the product.

Moreover, the packaging 1 preferably comprises a mover 7 to move the applicator 4 with respect to the receptacle 2 and, thus, the cosmetic product, arranged inside the containment volume 2*a*. Note that the mover 7 is suitable to move the applicator 4 with respect to the containment and release body 6.

The mover 7 is suitable to move the applicator 4 with respect to the cosmetic product along the longitudinal axis 1*a*.

Figure 2A:
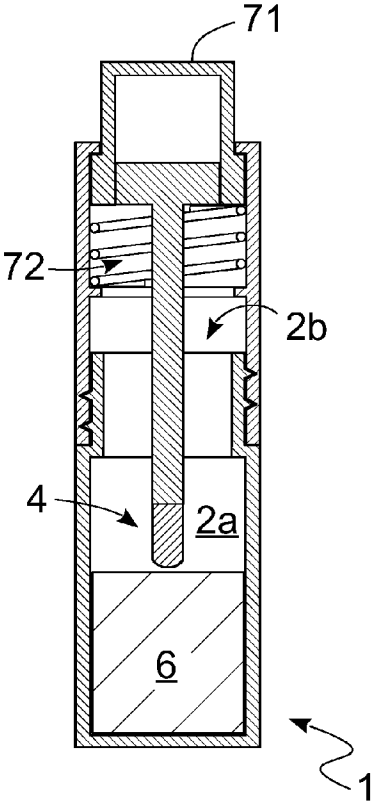
FIG. 2*a* illustrates a median cross-section of the packaging in FIG. 1.
Figure 1:
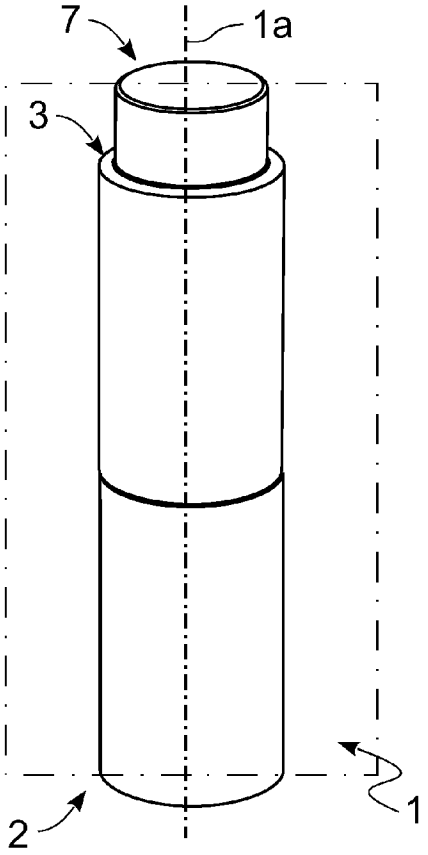
FIG. 1 shows a packaging for a cosmetic product according to the invention.

It is suitable to define, for the packaging 1, a raised position (FIGS. 2*a* and 4*a*) in which the applicator 4 is at the maximum distance from the bottom of the receptacle 2 and, conveniently, does not come into contact with the cosmetic product or slightly in contact with the same, and at least a lowered position (FIGS. 2*b* and 4*b*) in which the applicator 4 is at the minimum distance from the bottom of the receptacle 2.

Said distances are calculated along the longitudinal axis 1*a*.

Conveniently, in the lowered position the applicator 4 advantageously comes into contact with the cosmetic product so as to withdraw at least part of the cosmetic product. More advantageously, in the at least one lowered position the applicator 4 is at least partially inserted inside the containment and release body 6 so as to deform and, more precisely, contract said containment and release body 6 and withdraw at least part of the cosmetic product.

Figure 3:
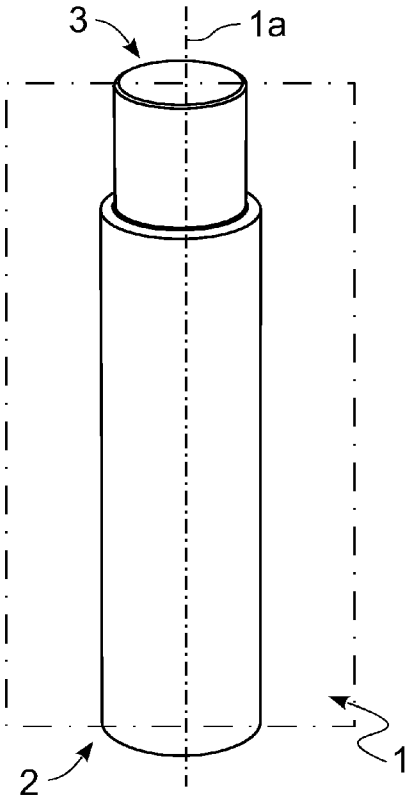
FIG. 3 is a second packaging for a cosmetic product according to the invention.

In a first case, the mover 7 is arranged between the lid 3 and the applicator 4 (FIGS. 1, 2*a*, 2*b*, 5, 6*a*-6*c*) and, in some cases, between the lid 3 and the stem 5 (FIGS. 3, 4*a*, 4*b*) so as to move the stem 5 and the applicator 4 with respect to the lid 3.

It may therefore comprise, as illustrated in FIGS. 2*a* and 2*b*, 6*a*-6*c*, a button 71 integral with the applicator 4 and with the stem 5 and return means 72 for returning the applicator 4 to the raised position arranged between the button 71 and the lid 3.

Figures 5, 6A, 6B, 6C:
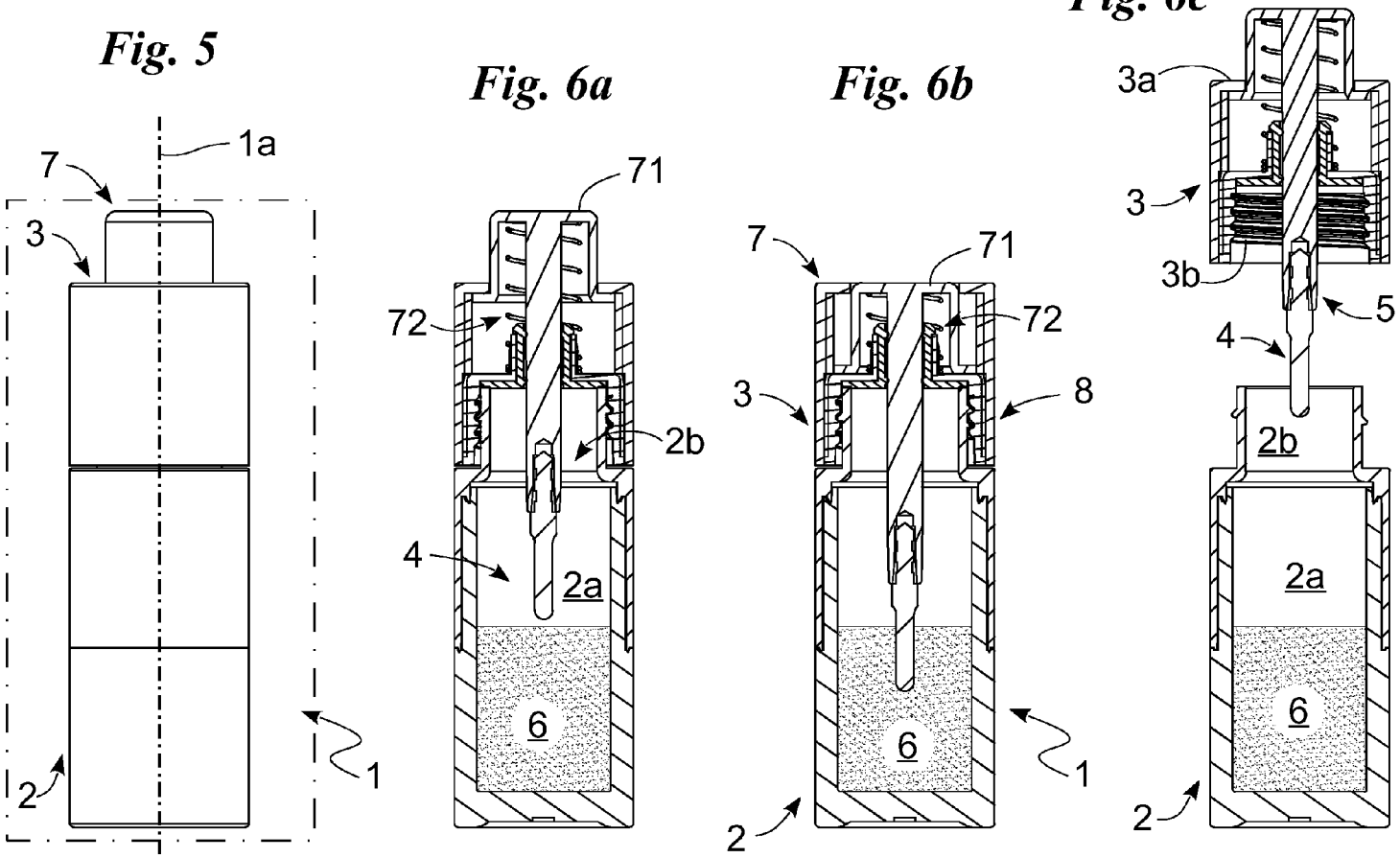
FIG. 5 is a third packaging for a cosmetic product according to the invention.
FIG. 6*a* illustrates a median cross-section of the packaging in FIG. 5 in a first configuration.
FIG. 6*b* illustrates a median cross-section of the packaging in FIG. 5 in a second configuration.
FIG. 6*c* shows a median cross-section of the packaging in FIG. 5 in a third configuration.

In this case, as illustrated in FIGS. 6*a*-6*c*, the lid 3 may be in two portions: a peripheral portion 3*a*, and an inner portion 3*b*, fitted inside of the peripheral portion 3*a* and including a thread for fastening to the container 2. The two portions 3*a* and 3*b* include the return means 72 and allow the assembly of the button 71.

In particular, the button 71 is detachably joined to the lid 3 so as to move and, appropriately, at least partially protrude from the lid 3 to facilitate its use.

Figure 4B:
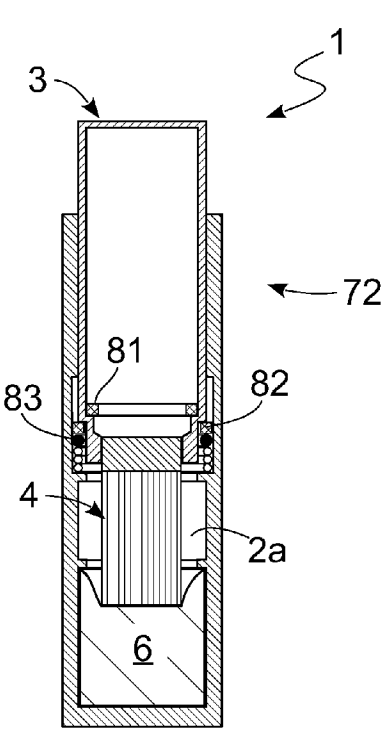
FIG. 4*b* shows the cross-section of FIG. 4*a* in a different configuration.
Figure 4A:
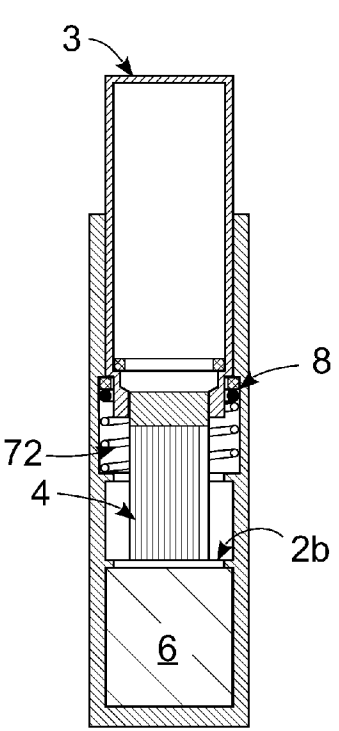
FIG. 4*a* illustrates a median cross-section of the packaging in FIG. 3.

In a second case, illustrated in FIGS. 4*a* and 4*b*, the mover 7 is arranged between the lid 3 and the receptacle 2 and so as to move the lid 3 and the applicator 4 with respect to the receptacle.

In this case, the button 71 defines said lid 3 and the return means 72 are arranged between the lid 3 and the receptacle 2.

In both cases, the return means 72 are suitable to oppose a passage to a lowered position and, more precisely, they are suitable to maintain the packaging 1 in the raised configuration when no force is applied from the outside.

The return means 72 may be elastic means and comprise a compression spring, preferably preloaded.

The lid 3 is suitable to releasably and, preferably, integrally, engage with the receptacle 2. For that purpose, the packaging 1 comprises joining means 8 between the lid 3 and the receptacle.

Said joining means 8 may be a threaded coupling (FIGS. 2*a* and 2*b*) or an interlocking coupling Alternatively, the joining means 8 may be magnetic (FIGS. 4*a* and 4*b*) and comprise a first magnet 81, or ferromagnet, appropriately attached to the lid 3, and a second magnet 82, appropriately attached to the receptacle 2, suitable to attract the first ferromagnet 81 to hold the packaging 1 closed when no external force is applied.

The first magnet 81 may be integral with the lid 3.

The second magnet 82 may be integral with the receptacle 2.

Alternatively, it may be arranged between the return means 72 and the lid 3. In detail, the second magnet 82 may be integral with the return means 72 and, more in detail, proximal to the lid 3 so as to reduce the distance from the first magnet 81 to a minimum.

Additionally, at least in the case of the magnetic joint 8, the joining means 8 may comprise a gasket 83, preferably an O-ring, suitable to make the packaging 1 substantially watertight when the lid 3 engages with the receptacle 2.

The functioning of a packaging for a cosmetic product, described above in a structural sense, is as follows.

To use the packaging 1, the user holds the receptacle 2 and, using the mover 7, moves the packaging from the raised position to the lowered position by sliding the applicator 4 and immersing it in the cosmetic product.

In particular, by pressing on the button 71 or on the lid 3, the user moves the applicator 4 along the longitudinal axis 1*a* towards the bottom of the receptacle 2 so that it presses against the containment and release body 6, deforming it. As a consequence, the containment and release body 6 contracts and, in doing so, reduces its volume.

As a result of said contraction, the containment and release body 6 releases at least part of the cosmetic product on the applicator 4 which is thus wet or soaked in the cosmetic product.

The invention comprises a new method for dispensing a cosmetic product and, in particular, a liquid cosmetic product.

The method is suitable to be implemented using the packaging 1 described above in a structural sense.

As specifically described above, the cosmetic product and, in particular, the liquid cosmetic product, is withdrawn by means of the deformation of a containment and release body 6 impregnated and, more in detail, saturated with the cosmetic product and, more in detail, with the liquid cosmetic product.

The invention achieves some important advantages.

One important advantage consists of the fact that the packaging 1 uses the product or liquid cosmetic product easily and quickly even when there is very little left.

The presence of the containment and release body 6 and, thus, the possibility of withdrawing the cosmetic product by deforming said containment and release body 6 makes it easy to withdraw and, thus, use the cosmetic product regardless of how much is left.

This advantage is achieved thanks to the containment and release body 6 which, when it expands after contracting, distributes the remaining product inside it, preventing this from building up on the bottom of the receptacle 2 and thus facilitating its subsequent withdrawal.

Lastly, note that thanks to the containment and release body 6, the loss of solvent or other volatile substances is reduced to a minimum, so that the cosmetic product is kept in perfect condition for a long time.

The possibility of using the product or liquid cosmetic product easily and quickly, even when there is very little left, is also guaranteed by the innovative presence of the mover 7 which, by moving the applicator 4 towards the bottom of the receptacle, reduces the distance to a minimum and, if appropriately dimensioned, brings the applicator 4 into contact with the bottom of the receptacle 2.

Moreover, thanks to said mover 7 there is always the right amount of liquid product on the applicator. Furthermore, the product can be dosed with precision, according to the preferences of the user, pushing more times the button 71.

Modifications and variations may be made to the invention described herein without departing from the scope of the inventive concept as expressed in the independent and dependent claims.

For example, the mover 7 may be constituted by a simple thread profile and the applicator is then movable by screwing the lid 3 along the vessel 2.

All details may be replaced with equivalent elements and the scope of the invention includes all other materials, shapes and dimensions.

The invention claimed is:

1. A packaging, comprising:

a receptacle defining a containment volume of a cosmetic product and an opening into said containment volume;

a lid configured to engage with said receptacle to close said opening;

an applicator configured to withdraw and to dose at least part of said cosmetic product from said containment volume;

a containment and release body arranged in said containment volume and impregnated with said cosmetic product and configured to be deformed by said applicator so as to release said cosmetic product on said applicator, a mover, to move said applicator with respect to said containment and release body, defining, while said lid is engaged with said receptacle closing said opening, a raised position in which said applicator is at the maximum distance from the bottom of said receptacle; and at least a lowered position in which the distance of said applicator from said bottom of said receptacle is less than said maximum distance so that said applicator deforms said containment and release body and withdraws at least part of said cosmetic product.

2. The packaging as claimed in claim 1, wherein said containment and release body is a porous body.

3. The packaging as claimed in claim 1, wherein said mover is arranged between said applicator and said receptacle and is configured to move said applicator with respect to said lid.

4. The packaging as claimed claim 1, wherein said mover is arranged between said lid and said receptacle and is configured to move said lid and said applicator with respect to said receptacle.

5. The packaging as claimed in claim 1, wherein said mover is a button and wherein when pushing said button, said applicator is moved along a longitudinal axis of said packaging bringing it at the minimum distance from the bottom of the receptacle.

6. The packaging as claimed in claim 5, wherein said button is on said lid.

7. The packaging as claimed claim 1, further comprising joining means between said lid and said receptacle, wherein said joining means comprise a first magnet integral with the lid and a second magnet integral with the receptacle, and configured to attract the first magnet so as to maintain the packaging in a closed position.

8. The packaging as claimed in claim 1, wherein said applicator is selected from the group consisting of a sponge, a brush and a flocked applicator.

9. The packaging as claimed in claim 1, wherein the cosmetic product is a fluid cosmetic product or a skin care product.

10. A method for dispensing a cosmetic product configured to be implemented using said packaging according to claim 1, wherein said cosmetic product is withdrawn by means of the deformation of said containment and release body impregnated with said cosmetic product.

* * * * *